US006475709B2

(12) United States Patent
Strijckers et al.

(10) Patent No.: US 6,475,709 B2
(45) Date of Patent: Nov. 5, 2002

(54) METHOD FOR THERMAL RECORDING

(75) Inventors: Hans Strijckers, Oudergem (BE); Karsten Dierksen, Cologne (DE); Robert Overmeer, Mortsel (BE); Patrick Van den Bergen, Hove (BE)

(73) Assignee: AGFA-Gevaert, Mortsel (BE)

( * ) Notice: Subject to any disclaimer, the term of this patent is extended or adjusted under 35 U.S.C. 154(b) by 5 days.

(21) Appl. No.: 09/728,467

(22) Filed: Nov. 30, 2000

(65) Prior Publication Data

US 2002/0094497 A1 Jul. 18, 2002

Related U.S. Application Data

(60) Provisional application No. 60/171,464, filed on Dec. 22, 1999.

(30) Foreign Application Priority Data

Dec. 1, 1999 (EP) ..... 99204070

(51) Int. Cl.[7] ..... B41J 2/32; B41J 2/475

(52) U.S. Cl. ..... 430/350; 430/22; 430/617; 430/619; 341/191

(58) Field of Search ..... 430/350, 22, 617, 430/619; 347/191; 250/316

(56) References Cited

FOREIGN PATENT DOCUMENTS

| | | |
|---|---|---|
| EP | 0 792 750 | 9/1997 |
| EP | 99 20 4070 | 5/2000 |
| JP | 60 208787 | 10/1985 |
| JP | 63274562 | 11/1988 |
| JP | 02081644 | 3/1990 |
| JP | 07314744 | 12/1995 |

*Primary Examiner*—Thorl Chea
(74) *Attorney, Agent, or Firm*—John A. Merecki; Hoffman, Warnick & D'Alessandro

(57) ABSTRACT

A method for recording an image on a thermographic material (m) provides a thermographic material, a transparent thermal head (TH) having energizable heating elements (Hi), and a radiation beam (L). The heating elements of the thermal head are activated and the radiation beam is passed through transparent parts of the thermal head. Herein, the total energy resulting from the thermal head and from the radiation beam has a level corresponding to a gradation of the image to be recorded. Further embodiments comprise e.g. holding the thermographic material on one and a same drum during both an imagewise exposing step and a heating step.

10 Claims, 7 Drawing Sheets

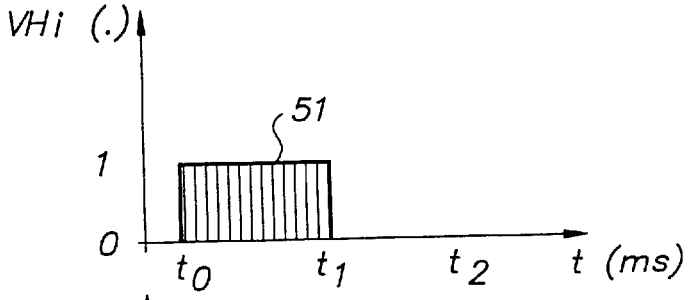
FIG. 4.1
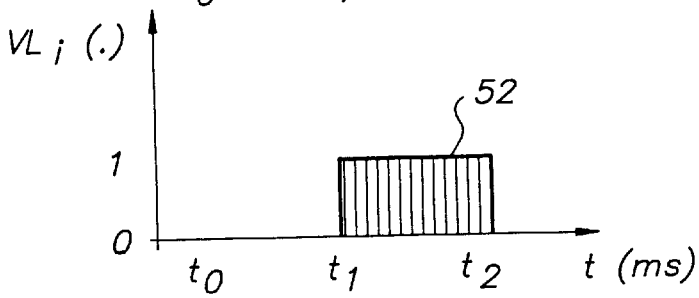
FIG. 4.2
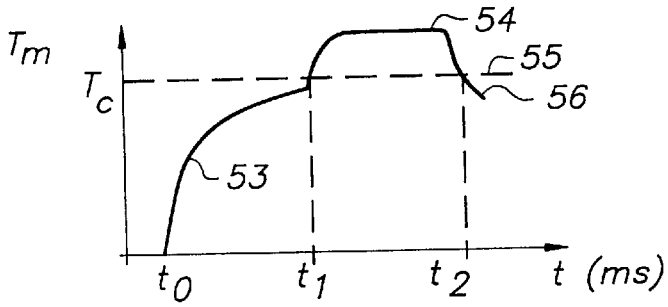
FIG. 4.3
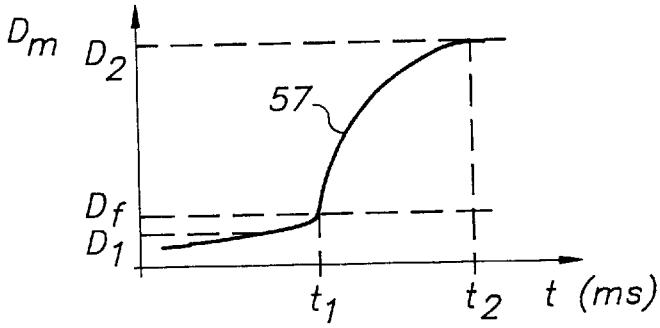
FIG. 5.1
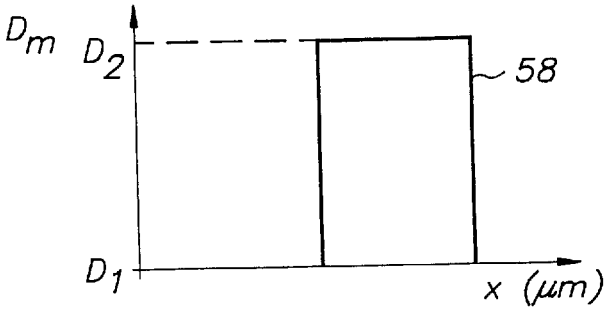
FIG. 5.2

METHOD FOR THERMAL RECORDING

This application claims benefit of Provisional application Ser. No. 60/171,464 filed Dec. 22, 1999.

FIELD OF THE INVENTION

The present invention relates to a method and a device for thermal recording by means of a thermal head having energisable heating elements. Even, more in particular, the invention is related to thermal recording by means of such a thermal head and a radiation beam, even more preferably a transparent thermal head and a laserbeam.

BACKGROUND OF THE INVENTION

Thermal imaging or thermography is a recording process wherein images are generated by the use of imagewise modulated thermal energy. Thermography is concerned with materials which are not photosensitive, but are sensitive to heat or thermosensitive and wherein imagewise applied heat is sufficient to bring about a visible change in a thermosensitive imaging material, by a chemical or a physical process which changes the optical density.

Most of the direct thermographic recording materials are of the chemical type. On heating to a certain conversion temperature, an irreversible chemical reaction takes place and a coloured image is produced.

In direct thermal printing, the heating of the thermographic recording material may be originating from image signals which are converted to electric pulses and then through a driver circuit selectively transferred to a thermal print head. The thermal print head consists of microscopic heat resistor elements, which convert the electrical energy into heat via the Joule effect. The electric pulses thus converted into thermal signals manifest themselves as heat transferred to the surface of the thermographic material, e.g. paper, wherein the chemical reaction resulting in colour development takes place. This principle is described in "Handbook of Imaging Materials" (edited by Arthur S. Diamond—Diamond Research Corporation—Ventura, Calif., printed by Marcel Dekker, Inc. 270 Madison Avenue, New York, ed. 1991, p. 498–499).

A particular interesting direct thermal imaging element uses an organic silver salt in combination with a reducing agent. An image can be obtained with such a material because under influence of heat the silver salt is developed to metallic silver.

FIG. 2 (not to scale) shows a cross-section of a composition of a thermographic material m suitable for application within the present invention. The material of the thermographic imaging element 3 comprises a polyethylene terephthalate (PET) support 65 of about 60 to 180 μm (e.g. 175 μm), carrying a subbing layer or substrate 66 of about 0.1 to 1 μm (e.g. 0.2 μml thickness, an emulsion layer 67 of about 7 to 25 μm (e.g. 20 μm) thickness, and a protective layer 68 of about 2 to 6 μm (e.g. 4 μm) thickness (sometimes called top-layer TL). Optionally, on the other side of the PET support 65 a backing layer 69 is provided containing an antistatic and/or a matting agent (or roughening agent, or spacing agent, terms that often are used as synonyms) to prevent sticking. Further details about the composition of such thermographic material m may be read in EP 0 692 733 (in the name of Agfa-Gevaert). The thermographic material can also contain one or more light-to-heat converting agents, preferably in layer 66, 67 or 68. This light-to-heat converting agent is often an infrared absorbing component and maybe added to the thermographic material in any form, e.g. as a solid particle dispersion or a solution of an infrared absorbing dye.

Referring to FIG. 1, there is shown a global principle schema of a thermal printing apparatus 10 that can be used in accordance with the present invention (known from e.g. EP 0 724 964, in the name of Agfa-Gevaert). This apparatus is capable of printing lines of pixels (or picture elements) Pi on a thermographic recording material m, comprising thermal imaging elements or (shortly) imaging elements, often symbolised by the letters Ie. As an imaging element Ie is part of a thermographic recording material m, both are indicated in the present specification by a common reference number 3. The thermographic recording material m comprises on a support a thermosensitive layer, which generally is in the form of a sheet. The imaging element 3 is mounted on a rotatable drum 15, driven by a drive mechanism (not shown) which continuously advances (see arrow Y representing a so-called slow-scan direction) the drum 15 and the imaging element 3 past a stationary thermal print head 16. This head 16 presses the imaging element 3 against the drum 15 and receives the output of the driver circuits (not shown for the sake of greater clarity). The thermal print head 16 normally includes a plurality of heating elements equal in number to the number of pixels in the image data present in a line memory. The imagewise heating of the heating element is performed on a line by line basis, the "line" may be horizontal or vertical depending on the configuration of the printer, with the heating resistors geometrically juxtaposed each along another and with gradual construction of the output density. Each of these resistors is capable of being energised by heating pulses, the energy of which is controlled in accordance with the required density of the corresponding picture element. As the image input data have a higher value, the output energy increases and so the optical density of the hardcopy image 17 on the imaging element 3. On the contrary, lower density image data cause the heating energy to be decreased, giving a lighter picture 17.

In input data block 22, first a digital signal representation is obtained; then, the image signal is applied via a digital interface to a storing means (not shown) of the thermal printer 10.

In the processing unit 24, the digital image signal is processed. Next the recording head 16 is controlled so as to produce in each pixel the density value corresponding with the processed digital image signal value. After processing electrical current may flow through the associated heating elements. In this way a thermal hard-copy 17 of the electrical image data is recorded. By varying the heat applied by each heating element to the carrier, a variable density image pixel is formed.

Although it is known to prepare both black-and-white and coloured half-tone images by the use of a thermal printing head, a need for an improved recording method still exists.

OBJECTS OF THE INVENTION

It is an object of the present invention to provide an improved method for recording an image on a thermal imaging element by means of a thermal head having energisable heating elements.

Other objects and advantages of the present invention will become clear from the further description and examples.

SUMMARY OF THE INVENTION

The above mentioned object is realised by a method and a system for generating an image on a heat.mode imaging element having the specific features defined respectively in the independent claims and illustrated e.g. in FIG. 3 (to be explained further on). Specific features for preferred embodiments of the invention are disclosed in the dependent claims.

Further advantages and embodiments of the present invention will become apparent from the following description and drawings.

BRIEF DESCRIPTION OF THE DRAWINGS

The invention will be described hereinafter with reference to the accompanying drawings (not necessarily to scale), which are not intended to restrict the scope of the present invention.

Herein,

FIGS. 4.1 to 4.3 respectively show the activation of a heating element, the activation of a radiation beam and the resulting temperature in the thermographic material m;

FIG. 5.1 shows the evolution of the density on the thermographic material m related to the scanning time;

FIG. 5.2. shows the resultant density on the thermographic material m after completion of the scanning and related to the scanning distance;

DETAILED DESCRIPTION OF THE INVENTION

Figure 1:
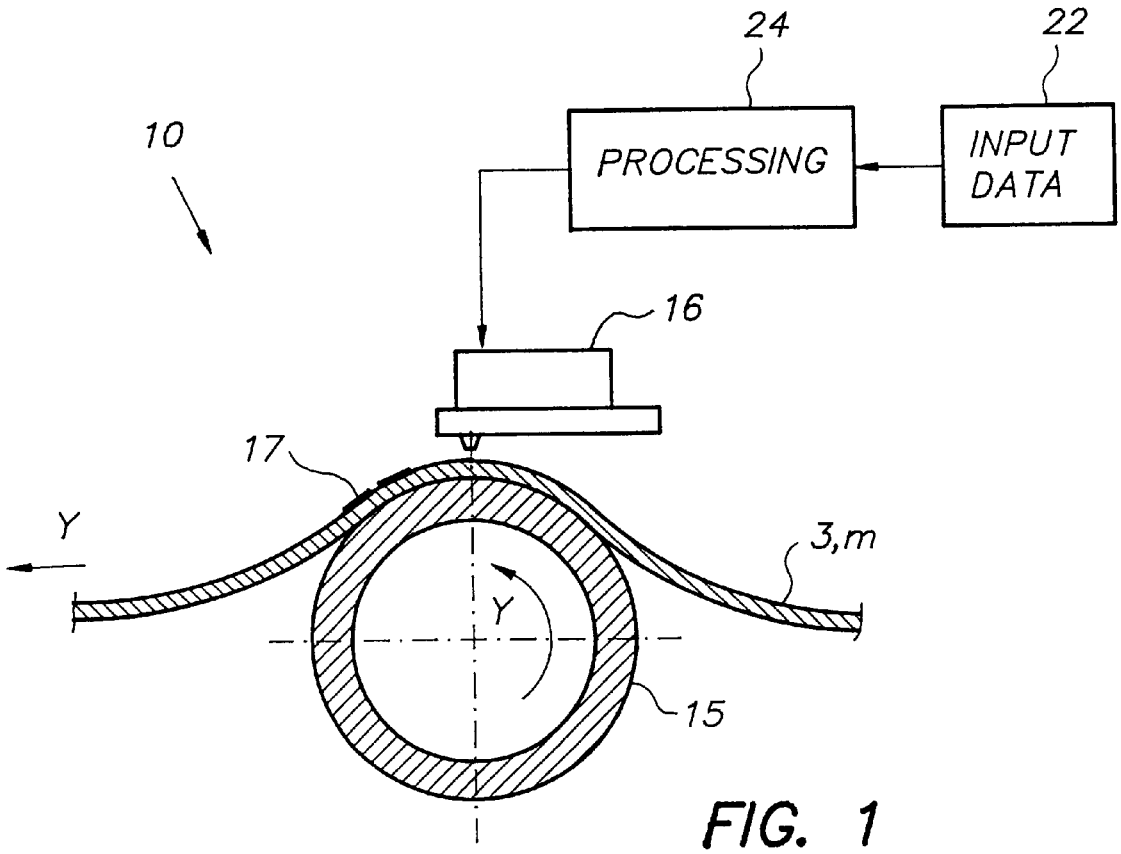
FIG. 1 shows the basic functions of a direct thermal printer.

The description given hereinafter mainly comprises six sections, namely (i) terms and definitions used in the present application, (ii) preferred embodiments of a transparent thermal head, (iii) preferred embodiments of methods using a transparent thermal head combined with a laser beam, (iv) photothermographic applicability of the present invention, (v) laserthermographic applicability of the present invention (vi) further applicability of the present invention.

More information about transparent thermal heads according to the present invention can be found in co-pending application entitled "THERMAL HEAD", filed on a same date and incorporated herein by reference.

(i) Explanation of Terms Used in the Present Description

For the sake of greater clarity, the meaning of some specific terms applying to the specification and to the claims are explained before use.

The term "thermographic material" (being a thermographic recording material, hereinafter indicated by symbol m) comprises both a thermosensitive imaging material add a photothermographic imaging material (being a photosensitive thermally developable photographic material).

For the purposes of the present specification, a thermographic imaging element Ie is a part of a thermographic material m (both being indicated by ref. nr. 3). Hence, symbolically: m ∋ Ie.

By analogy, a thermographic imaging element Ie, comprises both a (direct or indirect) thermal imaging element and a photothermographic imaging element. In the present application the term thermographic imaging element Ie will mostly be shortened to the term imaging element.

By the term "heating material" (hereinafter indicated by symbol hm) is meant a layer of material which is electrically conductive so that heat is generated when it is activated by an electrical power supply.

In the present specification, a heating element Hi is a part of the heating material hm. Hence, symbolically: hm ∋ Hi.

A heating element Hi (as e.g. H1, H2, H3 . . . ) being a part of the heating material hm is conventionally a rectangular or square portion defined by the geometry of suitable electrodes.

According to the present specification, a heating element is also part of a heating system, which system further comprises a power supply, a data capture unit, a processor, a switching matrix, leads, etc.

An "original" is any hardcopy or softcopy containing information as an image in the form of variations in optical density, transmission, or opacity. Each original is composed of a number of picture elements, so-called "pixels". Further, in the present application, the terms pixel and dot are regarded as equivalent.

Furthermore, according to the present invention, the terms pixel and dot may relate to an input image (known as original) as well as to an output image (in softcopy or in hardcopy, e.g. known as print).

It is known, and put to intensive commercial use (e.g. Drystar™, of Agfa-Gevaert N.V.), to prepare both black-and-white and coloured half-tone images by the use of a thermal printing head, a heat-sensitive receiving material (in case of so-called one-sheet thermal printing) or a combination of a heat-sensitive donor material and a receiving (or acceptor) material (in case of so-called two-sheet thermal printing), and a transport device which moves the receiving material or the donor-acceptor combination relative to the thermal printing head. The thermal head usually consists of a one-dimensional array of heating elements arranged on a ceramic substrate which is itself mounted on a heat-dissipating base element or heatsink hs. In the next paragraphs, a thermal head according to the present invention and a working method will be explained in depth.

By the wording "laserthermography" is meant an art of direct thermography comprising a uniform preheating step not by any laser and an imagewise exposing step by means of a laser.

It is known, and put to intensive commercial use (e.g. Drystar™, of Agfa-Gevaert N.V.), to prepare both black-and-white and coloured half-tone images by the use of a thermal printing head, a heat-sensitive receiving material or a combination of a heat-sensitive donor material and a receiving (or acceptor) material, and a transport device which moves the receiving material or the donor-acceptor combination relative to the thermal printing head. The thermal head usually consists of a one-dimensional array of heating elements arranged on a ceramic substrate which is itself mounted on a heat-dissipating base element. In the next paragraphs, such thermal printer, the components and the working method will be explained in depth.

(ii) Preferred Embodiments of a Transparent Thermal Head According to the Present Invention As already mentioned in the background section of the specification, methods and devices for thermal printing are known since many years, e.g. for direct thermal printing EP-0 622 217 (in the name of Agfa-Gevaert N.V.), etc. In these techniques, imagewise exposing of an imaging element is carried out by means of a thermal head having energisable heating elements.

Now, according to a first embodiment of the present invention, a thermal head having energisable heating elements is optically transparent materials. For a full description of such a transparent thermal head, reference is made to the co-pending patent application entitled "THERMAL HEAD", filed by the same patent assignee and on the same date; which is explicitly comprised within the instant application.

In the co-pending application, several advantages are explained. For the sake of conciseness, no redundant description is repeated in the instant specification.

Yet, it is indicated that, an important advantage of a transparent thermal head comprises the possibility of e.g. directing a density control through the thermal head, e.g. for controlling a density while it is formed on a the thermographic material.

Figure 9:
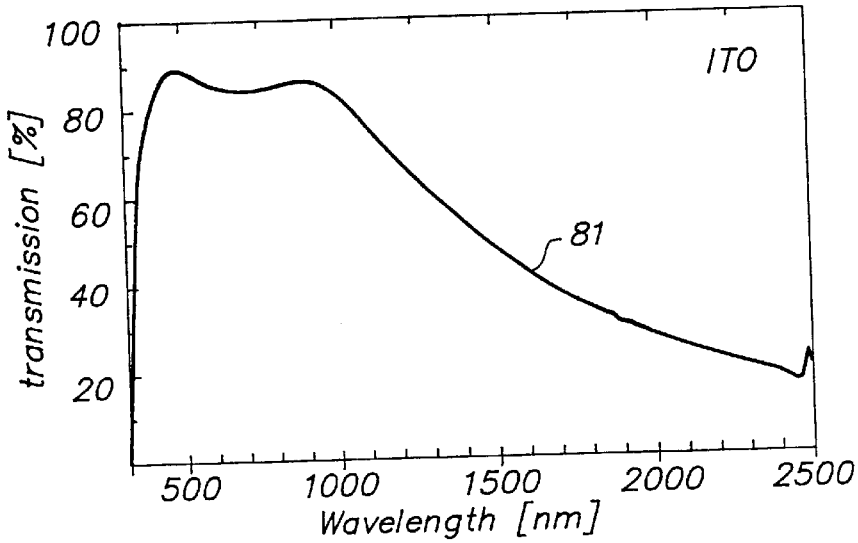
FIG. 9 is a diagram showing the optical transmission of ITO with respect to the wavelength of measurement, suitable for use according to the present invention.

FIG. 9 is a diagram showing the optical transmission of ITO with respect to the wavelength of measurement, suitable for use according to the present invention. Reference number 81 gives the transmittance curve of a heating material hm ITO.

According to the present invention, the heating material hm applied in the thermal head is optically transparent by having, in the wavelength range from 350 to 1200 nm, a transparency higher than 70%.

More preferably, the heating material hm is optically transparent by having in the wavelength range from 700 to 1100 nm a transparency higher than 80%.

In a further preferred embodiment of the present invention, the heating material hm has a transparency higher than 80% at least at the wavelength of the laserbeam (e.g. at 830, 870, 1054 or 1064 nm).

Figure 13:
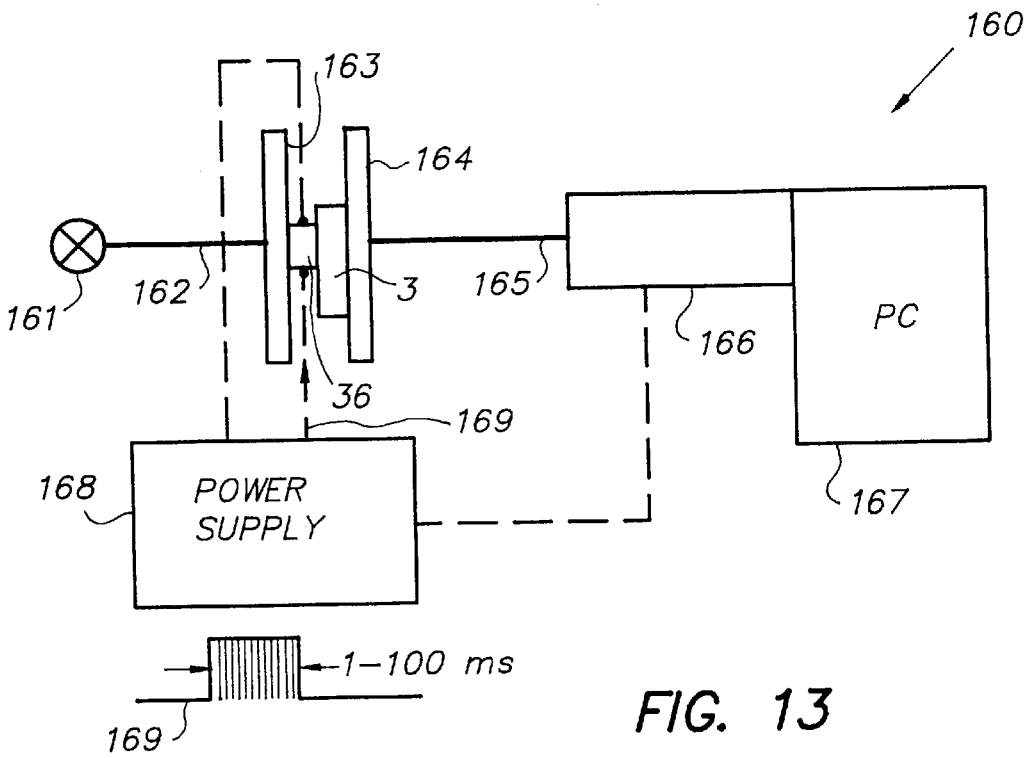
FIG. 13 is an equipment for measuring optical transmission of ITO related to the wavelength of exposure.

FIG. 13 is an equipment 160 for measuring the optical transmission of a heating material hm (such as ITO) related to the wavelength of exposure.

A heating material 36 (e.g. made from ITO) and a thermographic imaging element 3 are kept in place by two transparent-but-isolating means (e.g. glass plates) 163–164.

A light source (e.g. a halogen lamp) 161 sends a lightbeam 162 through the first glass plate 163 and through the transparent heating material 36 onto the thermographic imaging element 3 sustained by the second glass plate 164.

A power supply 168 brings a single square wave pulse 169 onto heating material 36, thus generating heat, in consequence of which the thermographic imaging element 3 develops an optical density to be measured. The amplitude of the pulse is chosen such as to generate an amount of heat sufficient to trigger the thermographic process and is related to the conductivity of the transparent heating material.

Advantageously the measuring equipment 160 comprises a spectrophotometer 166 having a certain wave-range (e.g. between 200 and 2500 nm) and registering a sufficient number of spectra in a given time-span (e.g. 18 spectra in 36 msec).

Evidently, a computer 167 is convenient for programming the experimental parameters and for carrying out the relevant calculations.

In a further preferred embodiment, the single square wave pulse 169 has a constant amplitude (of e.g. 46 Volt) but an increasing pulse width (of e.g. 6 ms, 8 ms, 10 ms . . . ). In another further preferred embodiment, the single square wave pulse 169 has an increasing amplitude (of e.g. 40 V, 45 V or 50 Volt) but a constant pulse width (of e.g. 10 ms).

By means of the spectrophotometer 166, it can easily be detected how and at which rate the optical density of the thermographic imaging element 3 increases as the power (e.g. between 5 and 10 $W/mm^2$) of the square wave pulse 169 increases. The same can be verified for different thicknesses of the heating material 36, e.g. between 0.1 and 30 $\mu$m, or between 0.2 $\mu$m and 5 $\mu$m.

Figure 10:
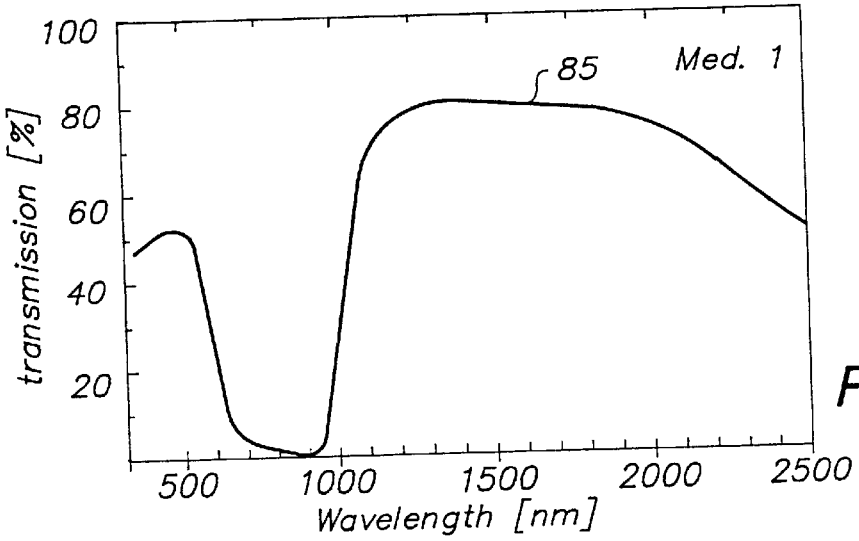
FIG. 10 is a diagram showing the optical transmission of a laserthermographic material, suitable for use according to the present invention.

FIG. 10 is a diagram showing the optical transmission (see ref. nr. 85) of a laserthermographic material (indicated as "Med. 1"), suitable for use according to the present invention.

Figure 11:
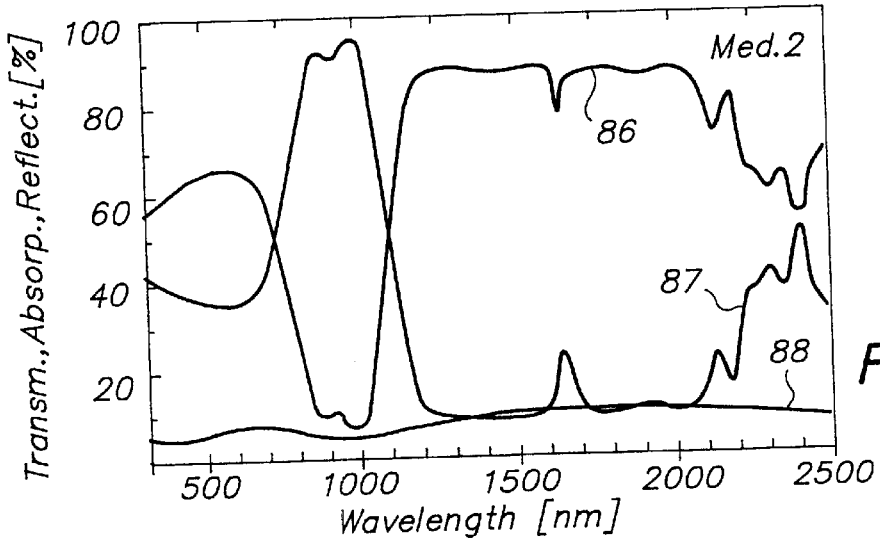
FIG. 11 is a diagram showing the optical transmittance, the absorption and the reflection curves with respect to the wavelength of measurement of another laserthermographic material, suitable for use according to the present invention.

FIG. 11 is a diagram showing the optical transmittance (see ref. nr. 86), the absorption (see ref. nr. 87) and the reflection (see ref. nr. 88) curves with respect to the wavelength of measurement of another laserthermographic material (indicated as "Med. 2"), suitable for use according to the present invention.

From comparison of e.g. FIGS. 9 and 10, it can be easily seen that a laser with a wavelength between 830 and 870 nm can be applied advantageously. Indeed, such laserbeam is efficiently transmitted through a heating material hm (e.g. ITO illustrated in FIG. 9) and is efficiently absorbed by a thermographic material (e.g. Med. 1 illustrated in FIG. 10).

From an analogue comparison of FIGS. 9 and 11, it can be easily seen that a laser with a wavelength of e.g. 1054 or 1064 nm can be applied advantageously. Indeed, such laserbeam is efficiently transmitted through a heating material hm (e.g. ITO illustrated in FIG. 9) and is efficiently absorbed by a thermographic material (e.g. Med. 2 illustrated in FIG. 11).

It is highly preferred in connection with the present invention to use a laser emitting in the infrared and/or near-infrared, i.e. emitting in the wavelength range 700–1500 nm. Suitable lasers include a Nd-YAG-laser (neodymium-yttrium-aluminium-garnet; 1064 nm) or a NdYLF laser (neodymium-yttrium-lanthanum-fluoride; 1053 nm). Typical suitable semiconductor laser diodes emit e.g. at 830 nm or at 860–870 nm.

The required laser power depends on the pixel dwell time of the laser beam, which is dependent on the scan speed (e.g. between 0.1 and 20 m/s, preferably between 0.5 and 5 m/s) and the spot diameter of the laser beam (defined at $1/e^2$ of maximum intensity e.g. between 1 and 100 $\mu$m, preferably between 10 and 25 $\mu$m).

Information about transparent heating materials usable in the present invention can be found in the above mentioned co-pending application entitled "THERMAL HEAD". E.g. the heating material hm may be selected from a group consisting of $In_2O_3$, optionally doped; $SnO/O_2$, optionally doped; ZnO, optionally doped; $Cd_2SnO_4$ or $CdSnO_3$; $Bi_2O_3$; $MoO_3$; $TiO_2$; $WO_2$; $RhO_2$; $ReO_2$; $Na_xWO_3$; $Zn_2SnO_4$ and V2O5. Another example comprises a commercial conductive and transparent polymer known as (registered tradename of Agfa-Gevaert), e.g. type ORGACON-EL.

First, it is known to people skilled in the art of thermography that thermal printing systems for recording an image of varied density utilise some type of sensor to detect a variable parameter (e.g. actual density or dot size) of the print. An electronic closed-loop system makes the necessary adjustments in the printing process. Now, it would be advantageous in many aspects, which will be explained completely in the detailed description, if the electronic control and the equipment could be compact.

Figure 3:
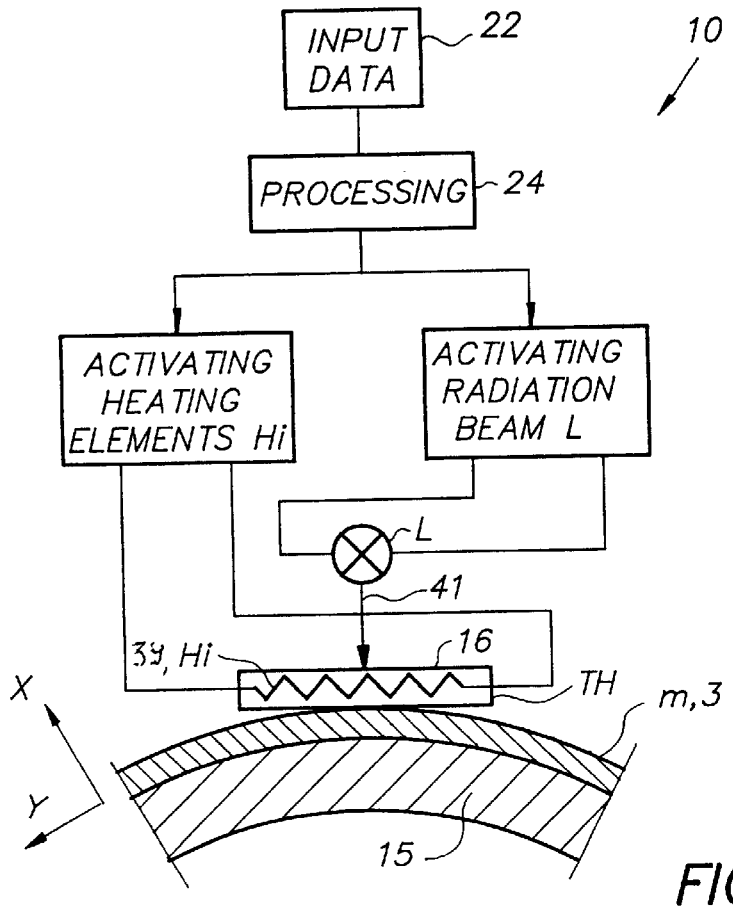
FIG. 3 shows a preferred embodiment of a method according to the present invention.

(iii) Preferred Embodiments of Methods Using a Transparent Thermal Head Combined with a Laser Beam According to the Present Invention FIG. 3 shows a preferred embodiment of a method according to the present invention, using a transparent thermal head combined with a laser.

Such method for recording an image on a thermal imaging element Ie comprises the steps of providing (e.g. by means of a rotatable drum 15) a thermographic material m (ref. nr. 3) having a thermal imaging element Ie, a transparent thermal head TH (ref. nr. 16) having energisable heating elements (Hi, ref. nr. 39), and a radiation beam L (ref. nr. 41), capturing input data (see input data block 22), processing (in processing unit 24) the digital image signals, activating heating elements of the thermal head and imagewise and scanwise exposing the imaging element by means of the radiation beam, wherein the imagewise and scanwise exposing is carried out by passing the radiation beam through transparent parts of the thermal head.

A preferred embodiment of a method for recording an image on a thermographic material m according to the present invention, comprises the steps of providing (see ref. nr. 131 in FIG. 12) a thermographic material having a thermal imaging element, a transparent thermal head TH having energisable heating elements Hi (ref. nr. 39), and a radiation beam L, activating (see ref. nr. 132) heating elements of the thermal head and imagewise and scanwise exposing the imaging element by means of the radiation beam, such that the total energy resulting from the thermal head and from the radiation beam has a level corresponding to a gradation (optionally also standing for e.g. density, colour, etc.) of the image to be recorded on the imaging element, wherein the imagewise and scanwise exposing is carried out by passing the radiation beam through transparent parts of the thermal head.

Another preferred embodiment of a method for recording an image on a thermographic material m according to the present invention, comprises the steps of providing (see ref. nr. 131) a thermographic material comprising the thermal imaging element, a transparent thermal head TH having energisable heating elements Hi (ref. nr. 39), and a radiation beam L, activating (see ref. nr. 133) heating elements such that a preheat temperature $T_0$ in the imaging element is reached which is below the conversion temperature Tc (see threshold level ref. nr. 55 in FIG. 4.3) of the imaging element, imagewise and scanwise exposing the imaging element by means of the radiation beam having a level of energy corresponding to a gradation of the image to be recorded on the imaging element, heating said thermal imaging element by a heating means (HM) such that a temperature (Tm) in the imaging element is reached which is higher than the conversion temperature (Tc) of the imaging element and which is apt for developing said thermographic material, wherein said imagewise and scanwise exposing is carried out by passing said radiation beam through transparent parts of said thermal head.

In a further preferred embodiment of a method according to the present invention, the heating means comprises a thermal head.

A further preferred embodiment of a method for recording an image on a thermographic material m according to the present invention, comprises the steps of providing (see ref. nr. 134) a thermographic material comprising a thermal imaging element, at least two thermal heads TH1, TH2 having energisable heating elements Hi, and a radiation beam L, imagewise and scanwise exposing the imaging element by means of the radiation beam having a level of energy corresponding to a gradation of the image to be recorded on the imaging element, activating (see ref. nr. 135) during a first heating time t1 heating elements of one of the thermal heads such that a first temperature Tm1 in the imaging element is reached, activating during a second heating time t2 heating elements of the other one of the thermal heads such that a second temperature Tm2 in the imaging element is reached, wherein the imagewise and scanwise exposing is carried out by passing the radiation beam through transparent parts of one of the thermal heads.

In a further preferred embodiment, the method comprises before the imagewise and scanwise exposing, an additional step of activating heating elements such that a preheat temperature $T_0$ in the imaging element is reached which is below the conversion temperature Tc (ref. nr. 55) of the imaging element (see ref. nr. 136).

In further preferred embodiments, in a method according to the present invention, the heating step and the exposing step are carried out at least partly simultaneously.

In further preferred embodiments, in a method according to the present invention, the activating of heating elements (ref. nr. 39) of a thermal head is carried out imagewise.

In further preferred embodiments of a method according to the present invention, the imagewise and scanwise exposing by means of a radiation beam is modified in that the imagewise and scanwise exposing is carried out by means of a laserdiodearray (see ref. nr. 137).

In further preferred embodiments of a method according to the present invention, the thermographic material is on one and the same holding or guiding means (e.g. drum 15) during both the imagewise exposing step and the heating step.

The method according to the present invention may also comprise an additional step of controlling the activating heating elements of a transparent thermal head by monitoring the gradation (or density, or colour) while developing the thermal imaging element by passing a monitoring beam through the transparent thermal head (see ref. nr. 138).

Figure 12:
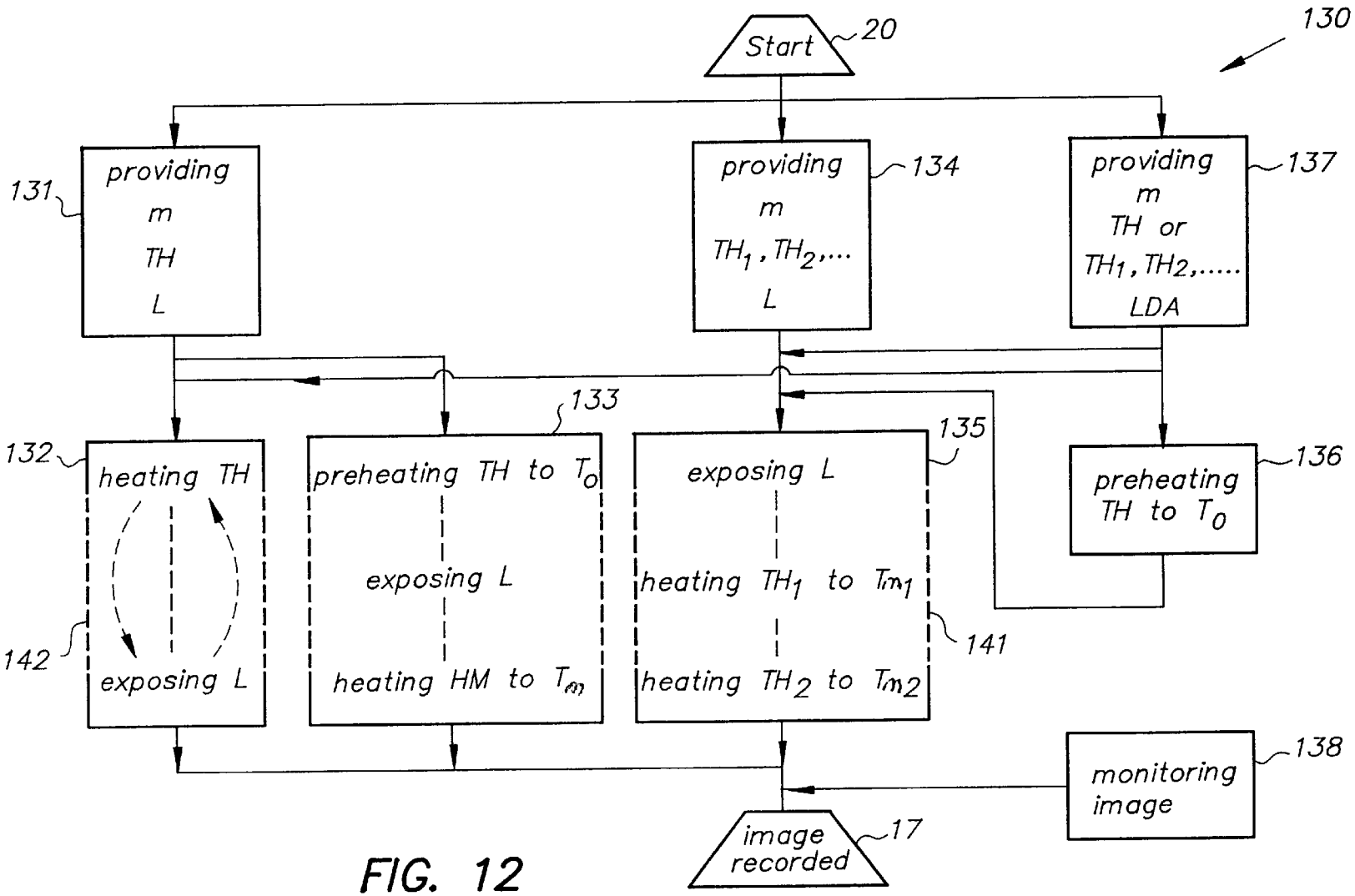
FIG. 12 gives a survey flow-chart of several method-steps according to the present invention.

FIG. 12 gives a survey flow-chart of several method-steps according to the present invention. As, after having disclosed a lot of preferred embodiments according to the present invention, a separate disclosure in full depth of FIG. 12 seems to be redundant. Yet, some remarks may be relevant: (1) dash lines indicate that no explicit duration of time is stated, (2) arrowed dash lines indicate that no restrictive order of sequence is stated, (3) preheating may be applied in many embodiments, (4) a monitoring of the image (say gradation, or density or colour) also may be applied in many embodiments, (5) in some embodiments more than one thermal head (e.g. TH1, TH2) may be applied, (6) in some embodiments a laserdiodearray LDA may be applied.

Figure 6:
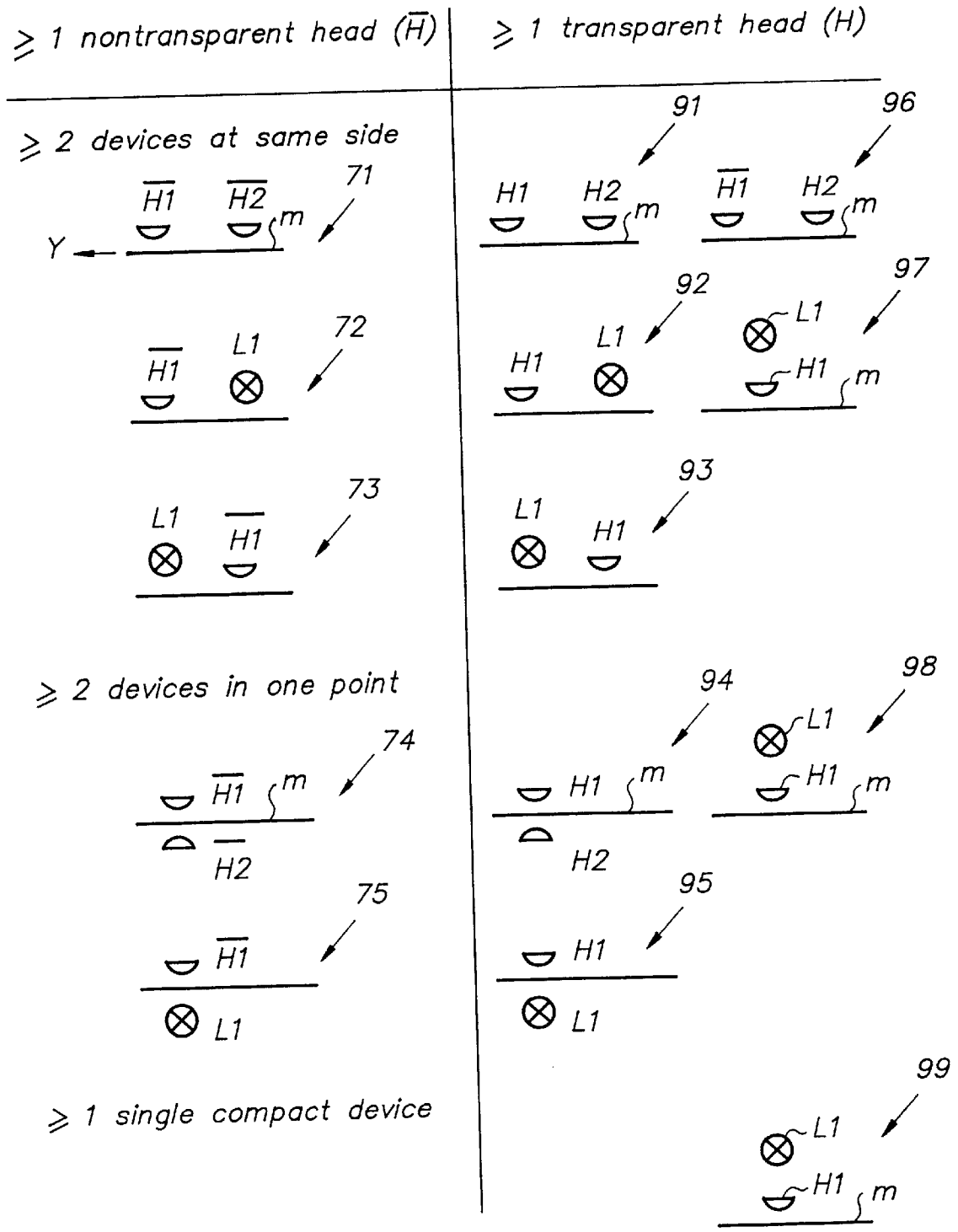
FIG. 6 shows several preferred hardware-embodiments of a method according to the present invention.

FIG. 6 shows several preferred hardware-embodiments of a method according to the present invention.

Before analysing all these implementations, it feels good to indicate that in this particular drawing, transparent thermal heads are indicated 6 by a single capital H; whereas non-transparent thermal heads are indicated in FIG. 6 by a single capital H with an "upperscore". Moreover, at the top of this drawing, for the sake of completeness, indicated are a non-transparent thermal head H (at the left side) known from prior art and a transparent head H (at the right side) according to the above-mentioned co-pending application.

In Fig. it is illustrated that the use of a transparent head offers more options for designing the thermal recording unit (w.r.t. the later FIG. 7, also referred to as imaging and processing unit 125) than a nontransparent head. The illustrations are made in a schematical form, wherein symbol m indicates a thermal imaging material and wherein symbol Y (see also FIGS. 1, 3, 7 and 8) indicates the slowscan direction. At the left side several embodiments are grouped which comprise at least two devices comprising at least one nontransparent thermal head; these devices may be situated at a same side of the thermographic material m, or on opposite sides of m. At the right side several embodiments are grouped which comprise at least two devices, more in particular comprising at least one transparent thermal head; these devices may be situated at a same side of the thermographic material m, or on opposite sides of m, or even integrated within one single compact device.

Reference number 71 illustrates schematically a thermal comprising two non-transparent thermal heads ($\overline{H1}$ and $\overline{H2}$) situated at a same side of m and operating in sequential order (along direction Y). Herein, $\overline{H1}$ may uniform preheat the thermographic material m, whereas $\overline{H2}$ imagewise heats the thermographic material m.

Ref. nr. 72 illustrates schematically a thermal recording unit comprising a non-transparent thermal head ($\overline{H1}$) and a laser (L1) situated at a same side of m and operating in sequential order (along direction Y). Herein, $\overline{H1}$ may uniform preheat the thermographic material m, whereas L1 imagewise exposes the thermographic material m.

Ref. nr. 73 relates to a thermal recording unit comprising a laser (L1) and a non-transparent thermal head ($\overline{H1}$) and situated at a same side of m and operating in sequential order (along direction Y). Herein, L1 may uniform preheat the thermographic material m, whereas $\overline{H1}$ imagewise activates the thermographic material m.

Ref. nr. 74 relates to a thermal recording unit comprising at least two non-transparent thermal heads ($\overline{H1}$, $\overline{H2}$) and situated at opposite sides of m and operating in sequential or in non-sequential order (along direction Y). Herein, e.g. $\overline{H1}$ may uniform preheat the thermographic material m, whereas $\overline{H2}$ imagewise activates the thermographic material m.

Ref. nr. 75 relates to a thermal recording unit comprising at least one non-transparent thermal head ($\overline{H1}$) and at least one laser (L1) situated at opposite sides of m and operating in sequential or in non-sequential order (along direction Y). Herein, e.g. $\overline{H1}$ may uniform preheat the thermographic material m, whereas L1 imagewise exposes the thermographic material m.

Ref. nr. 91 illustrates schematically a thermal recording unit comprising two transparent thermal heads (H1 and H2) situated at a same side of m and operating in sequential order (along direction Y). Herein, H1 may uniform preheat the thermographic material m, whereas H2 imagewise heats the thermographic material m.

Ref. nr. 96 illustrates schematically a thermal recording unit comprising two thermal heads ($\overline{H1}$ and H2), in particularly one non-transparent head ($\overline{H1}$) and one transparent head (H2), situated at a same side of m and operating in sequential order (along direction Y). Herein, e.g. $\overline{H1}$ may uniform preheat the thermographic material m, whereas H2 imagewise activates the thermographic material m.

Ref. nr. 92 illustrates schematically a thermal recording unit comprising a transparent thermal head (H1) and a laser (L1), both situated at a same side of m and operating in sequential order (along direction Y). Herein, e.g. H1 may uniform preheat the thermographic material m, whereas L1 imagewise exposes the thermographic material m. Ref. nr. 93 illustrates an analogue system, but with inverted positions of L1 and H1, and corresponding functions; e.g. L1 imagewise exposes the thermographic material m and H1 heats (uniform or imagewise) the thermographic material m as in case of photothermography.

Ref. nr. 97 illustrates schematically a thermal recording unit comprising a transparent thermal head (H1) and a laser (L1), both situated at a same side of m and at a same locality along direction Y. Herein, e.g. H1 may uniform preheat the thermographic material m, whereas L1 imagewise exposes the thermographic material m in case of laserthermography, or e.g. L1 imagewise exposes the thermographic material m and H1 heats (uniform or imagewise) the thermographic material m in case of photothermography.

Ref. nr. 94 is somewhat similar to ref. nr. 74, but comprises at least two transparent thermal heads (H1, H2) and corresponding functions.

Ref. nr. 95 is somewhat similar to ref. nr. 75, but comprises at least one transparent thermal head (H1) and corresponding functions. Ref. nr. 98 is somewhat similar to ref. nr. 92, but now both devices (H1, L1) are at the same side and at a same position along Y.

Ref. nr. 99 is somewhat similar to ref. nrs. 97 and 98, but now both devices (H1, L1) are at the same side and at a same position along Y and integrated within one single and compact device, e.g. a transparent thermal head as disclosed in the above-mentioned co-pending patent application.

A second important advantage of a transparent thermal head comprises the possibility of e.g. directing a recording radiation beam through the thermal head. For example, a combination of a transparent thermal head and a radiation beam, the combination being suitable for thermally operated printing devices, is e.g. illustrated in FIG. 8 (to be explained in a later paragraph).

Because of the transparency of the head, laser recording can be applied (i) from the same side and (ii) at the same location relative to the thermographic material as the heating with the thermal head.

The possibility of a laser recording being applied from the same side relative to the thermographic material as the heating with the thermal head, renders an important advantage. Indeed, in known thermal printers (see e.g. FIG. 1), a first heating (e.g. by a heated drum 15, or platen, or roll) is often given from the backside, whereas a second heating (e.g. by means of heating elements Hi) is given from the frontside of the thermographic material m. This prior art comprises a disadvantage in heating the imaging element 3 from the backside. Indeed, support layer 65, being formed of a plastic (such as PET), is not a particularly good thermal conductor. Therefore it takes slightly longer for the temperature in the emulsion layer 67 to build up to the threshold value than if the thermal energy is applied directly to the emulsion layer 67. This, of course, slows down the recording process.

An embodiment which uses a thermal head, being non-transparent or being transparent, and a radiation beam at a same side of thermographic material m, resolves the just mentioned problem. But, in case of a non-transparent thermal head, some distance is needed between the thermal head and the radiation beam (because of constructional dimensions), which introduces another disadvantage.

In fact, after having received a first energy of the heating elements, the temperature on thermographic material m will decrease before entering the impact region of the laser beam.

If a transparent thermal head and a laser beam are combined at the same side and at the same place of the thermographic material m, both mentioned disadvantages are solved.

Because a laser diode emits light which is converted to heat upon impact with emulsion layer 67, it does not have to make contact with emulsion layer 67 as does a resistive heating element 39. Therefore, the laser 118 and the thermal head 16 may be located on the same side and on the same location (see also ref. 99 in FIG. 6). This is possible because thermal print head TH does not block nor obscure the field of view of the laser beam L. Thus, in this configuration of a thermal recording system, there is no need to apply heat to emulsion layer 67 from the backside through support 65.

Figure 2:
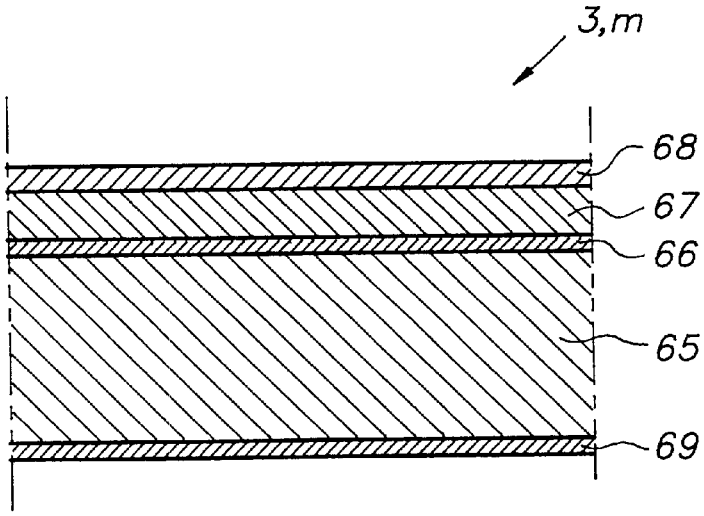
FIG. 2 shows the composition of a thermographic material suitable for application within the present.

By further consequence, it is also possible by the present invention to attain a greater sharpness, because there is only a very small distance between the heat source and the heat sensitive thermographic material. (The laser does not have to travel through support 65 (see FIG. 2) and hence no unsharpness is created by light diffraction caused by differences in the refractive index of the different layers of the thermal imaging material located between the thermosensitive layer and the light source.

In addition, as the heat can be applied very locally by the combination of a transparent thermal head and an actinique radiation beam, the fog can be lowered, thus upgrading the quality of discriminance in information (cf. ratio of Dmax to Dmin).

Another advantage of this invention is that the dimensional stability is improved due to the very local and short heating by the combination transparent thermal head. The use of a thermal head for an increased dimensional stability is described in the patent EP 0 933 672 of Konica. In the cited patent it is explained that a good size repetition accuracy is necessary in graphic arts imaging materials used for colour printing. However another requirement for high quality colour printing is a resolution of at least 1200 dpi, more preferably 2400 dpi.

In a further preferred embodiment of the present invention, a high resolution image can be obtained by applying a laserbeam through the thermal head, wherein the laserspot is smaller in dimensions than a heating element of the thermal head. Moreover, the laser and thermal head can be installed into the thermal recording unit as a single compact device. This allows the thermal recording unit itself to be a compact device rendering high resolution images.

FIGS. 4.1 to 4.3 respectively show the activation (see VHi) of a heating element Hi (ref. nr. 39), the activation (see VLi) of a radiation beam L and the resulting temperature (see Tm) in the thermographic material m. For the sake of clarity, and in reference to FIG. 4.1, it is supposed that from a time t0 to t1, a predefined voltage VHi (commonly between 12 and 18 V, e.g. 15 V) is supplied to the heating elements Hi of a transparent thermal head TH. This pulse is indicated by ref. nr. 51 and has an amplitude symbolised by logical level 0 for the off-state and logical level 1 for the on-state. It also is supposed that thereafter, say from time t1 to time t2, another binary pulse 52 is given e.g. to a suitable laser L (see FIG. 4.2). Now, according to a preferred embodiment of the present invention and as illustrated in FIG. 4.3, the temperature (Tm) in the thermographic material m first increases along a first heating curve 53 from time t0 to t1, then increases along a second heating curve 54, optionally to a stable level corresponding with a desired density level, and thereafter e.g. decreases along a third heating (or cooling) curve 56. Symbol Tc (ref. nr. 55) indicates the threshold temperature of the thermographic material m.

FIG. 5.1 shows the evolution of the density (see Dm) on the thermographic material m related to the scanning time. A density evolution along curve 57 starts from an initial density D1 (generally being as low as possible, but restricted by the optical density of the untreated thermal imaging material if no decolourizing components or layers are present in the thermal imaging material, and also influenced by a possible fog Df). At a time t1 threshold temperature or conversion temperature Tc has been surpassed, and the density of thermographic material m increases to a desired level D2.

FIG. 5.2. shows the resultant density on the thermographic material m after completion of the scanning time and is related to the scanning distance. The endresult renders a pixel 58 at a desired level of density D2.

(iv) Photothermographic Applicability of the Present Invention

The present invention can be applied advantageously in so-called photothermography.

Thermally processable silver-containing materials for producing images by means of imagewise exposing followed by uniform heating are generally known. A typical composition of such thermographically imaging elements includes photosensitive silver halide in combination with an oxidation-reduction combination of, for example, an organic silver salt and a reducing agent therefor.

These combinations are described, for example, in U.S. Pat. No. 3,457,075 (Morgan) and in "Handbook of Imaging Science", D. A. Morgan, ed. A. R. Diamond, publ. by Marcel Dekker, 1991, n chapter 2, pages 43–60, entitled "Dry Silver Photographic Materials".

An overview of thermographic systems is given in the book "Imaging Systems" by Kurt I. Jacobson and Ralph E. Jacobson, The Focal Press, London and New York, 1976, in chapter V under the title "Systems based on unconventional processing" and in chapter VII, entitled "thermographic systems", in particular "7.1 Thermography" and "7.2 Photothermography".

Photothermographic imaging elements are typically processed by imagewise exposure, for example in contact with an original or after electronic image processing with the aid of a laser, as a result of which a latent image is formed on the silver halide.

In a subsequent heating step the latent image formed exerts a catalytic effect on the oxidation-reduction reaction between the reducing agent and the non-photosensitive organic silver salt, usually silver behenate, as a result of which a visible density is formed at the exposed locations. The processing conditions are defined by the choice of the non-photosensitive organic silver salt and a reducing agent therefor. For example, the processing temperature is around 120° C. (or 393 K), for five seconds. Further information on the thermographic materials and on such imagewise exposures can be found, for example, in Patent Application EP A 96.201.530.1. of Agfa-Gevaert. Now, in one preferred embodiment of the present invention, the imagewise exposing is carried out by means of a radiation beam, while the uniform heating afterwards is carried out by means of a thermal Head. By doing so, even an increase of the sensitivity of photosensitive thermally developable photographic materials is attained, so that less powerful heat sources can be sufficient.

(v) Laserthermographic Applicability of the Present Invention

Figure 7:
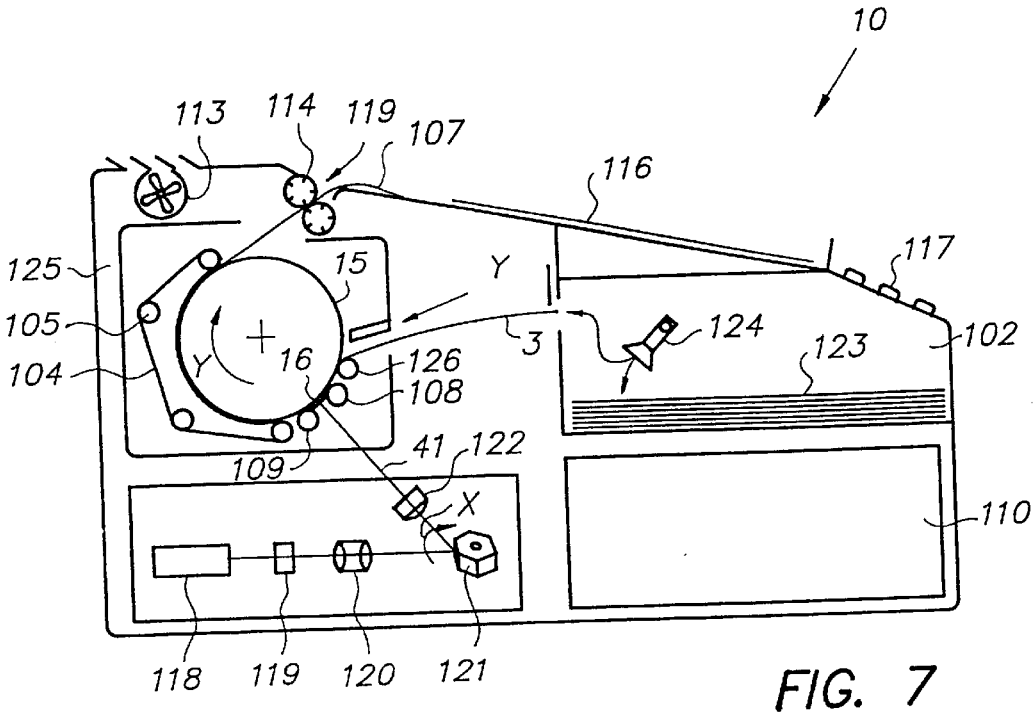
FIG. 7 shows a preferred embodiment of a laserthermographic apparatus with a flying spot laser and a thermal head according to the present invention.

From the preceding it might be clear for people skilled in the art, that in laserthermography a remarkable simplification of the processing equipment may be attained. In FIG. 7, which shows a preferred embodiment of a laserthermographic apparatus according to the present invention, the same ref. nr. numbers are used as in the preceding description. Hence, e.g. ref. 3 is the thermographic imaging element, 16 is a thermal print head, 41 is a laser beam, 102 a supply magazine, 104 a belt, 105 a tension roller, 107 a sheet of thermographic material, 108 a roller, 109 a roller, 110 a controller, 113 a ventilator, 116 imaged and processed sheets, 117 a keyboard, 118 a laser source, 119 a modulator, 120 a first objective, 121 a polygon mirror, 122 a second objective, 123 blank sheets to be imaged, 124 a sheet feeder, 125 an imaging and processing unit, 126 a pressure roller. For a better understanding, it is indicated that a full description of a laserthermographic printer (although definitely not with a thermal print head, but instead with a heated drum) can be found in DE-A 196 36 253.0. of Agfa-Gevaert.

Figure 8:
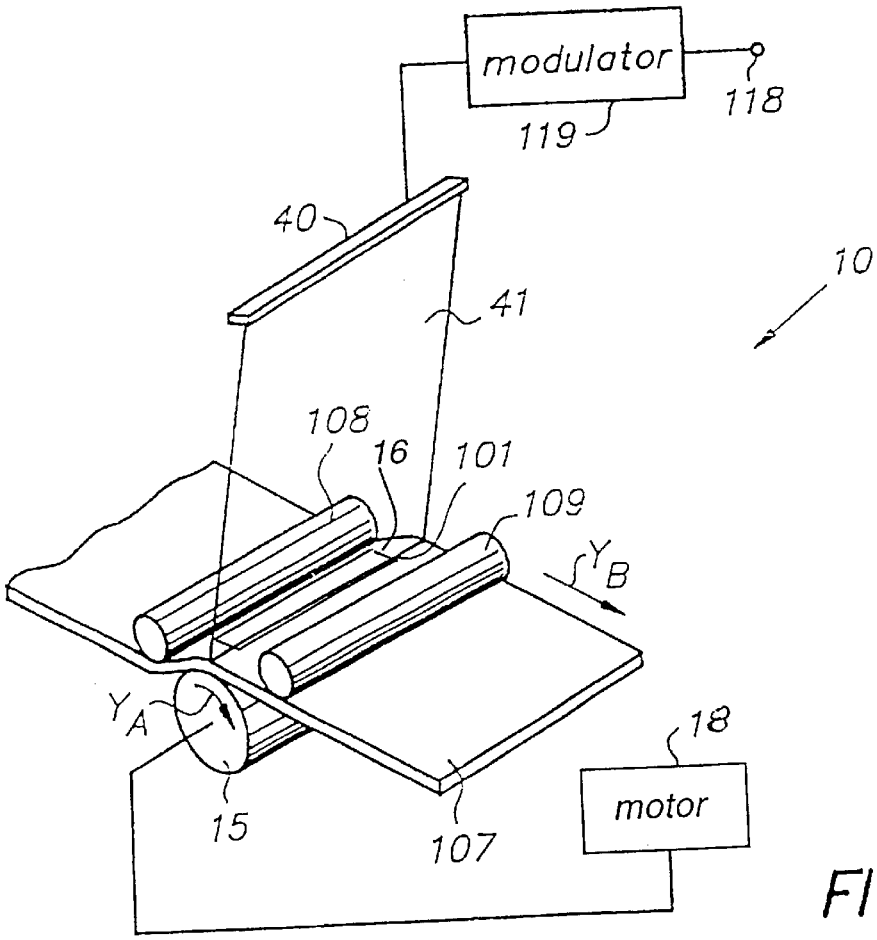
FIG. 8 shows a preferred embodiment of a laserthermographic apparatus with an array of laser diodes and a thermal head according to the present invention.

FIG. 8 shows a preferred embodiment of a laserthermographic apparatus with an array of laser diodes and a thermal head according to the present invention. As like reference numbers constitute like functions, no redundant description is repeated for the sake of conciseness. Additional reference numbers 40 represent a laserdiodearray, 101 an impact line of the exposure through a transparent thermal head 16, and 18 a motor for rotating the drum 15.

In short, use of a method according to anyone of the preceding embodiments, at least in photothermography and in laserthermography is explicitly enclosed by the instant invention.

(vi) Further Applicability of the present Invention

Thermal imaging can be used for production of both transparencies and reflection-type prints. In the hard copy field, thermographic recording materials based on an opaque, usually white, base are used, whereas in the medical diagnostic field monochrome, usually black, images on a transparent base find wide application, since such prints can conveniently be viewed by means of a light box.

In the present invention it should be clear that reflection-type prints on an opaque base can be produced more easily with a thermal recording unit comprising a transparent thermal head and laser located in one point (the embodiments 98 and 99 of FIG. 6). In embodiment 75, the preferred situation of having the nontransparent head on the same side of the thermosensitive layer is only possible if the opaque base has a high transparency at the wavelength of the laser light source. In the case that the nontransparent thermal head has to be located at the backside of the thermal imaging material (i.e. opposite side of the thermosensitive layer) a slow down of the recording process occurs as described above.

"Direct thermal printing" may be directed towards a method of representing an image of the human body obtained during medical imaging and most particularly to a printer intended for printing medical image picture data received from a medical imaging device.

More in particular, the image data may be medical image picture data received from a medical image camera.

However, in another preferred embodiment of the present invention, the image data may be graphical image picture data received from a computerised publishing system.

For example, image data may be in the form of screens representing graphical images for use in printing art. These screens can be obtained by computer Desk-Top Publishing systems, such as e.g. Ventura Publisher™. These systems combine both text and pictures, retrieved from e.g. manual input in word processors, OCR, picture scanners and software used for image manipulation (e.g. Adobe Photoshop™). Such systems output alphanumeric data in different file formats, that can be defined by the user, such as e.g. Postscript™. These output files can be transformed to a format that can be "understood" by the thermal printer. If necessary, additional data can be attached to the file to control the settings of the printer.

Hereabove, "direct thermal printing" mainly comprises so-called monosheet imaging elements (indicated by ref. nr. 3 in FIG. 1).

However, "direct thermal printing" also comprises a so-called "donor ribbon or donor element"—which may be "a protective ribbon" or which may be "a reduction ribbon"—and a so-called "receiving element". More information hereabout can be found in the above-mentioned co-pending application entitled "THERMAL HEAD".

Direct thermal monosheet imaging elements are described in e.g. EPA-94.201.717.9 and EPA-94.201.954.8 (both in the name of Agfa-Gevaert) and in WO 94/16361 (in the name of Labelon Corp. USA). Direct thermal printing with a so called protective ribbon is described e.g. in EPA-92.204.008.4 (in the name of Agfa-Gevaert). Direct thermal printing with a so called reduction ribbon is described e.g. in EPA-92.200.612.3 (in the name of Agfa-Gevaert).

It is of great advantage to know that the method of the present invention is applicable in each of these printing techniques. Because said printing techniques are already described in the just mentioned EPA applications, no redundant details are duplicated.

While the present invention has been described in connection with preferred embodiments thereof, it will be understood that it is not intended to limit the invention to those embodiments. Moreover, having described in detail preferred embodiments of the current invention, it will now be apparent to those skilled in the art that numerous modifications can be made therein without departing from the scope of the invention as defined in the appending claims.

Apparatus for recording an image on a thermographic material (m) incorporating anyone of the preceding methods is also included within the present invention.

PARTS LIST

3 thermographic material m/imaging element Hi
10 thermal printer
15 drum
16 thermal print head
17 hardcopy image
18 motor for drum
20 start of recording
22 input data
24 processing unit

36 heating material hm
39 heating element Hi
40 laserdiodearray
41 radiation beam L
51 activation pulse for heating element
52 activation pulse for radiation beam
53 first heating curve
54 second heating curve
55 conversion temperature Tc
56 third heating curve
57 density evolution over time
58 end-density over distance
65 support
66 substrate
67 emulsion layer
68 protective layer
69 backing layer
71–75 five uses of at least one non-transparent thermal head
91–99 nine uses of at least one transparent thermal head
81 transmittance curve of heating material ITO
85 transmittance curve of laserthermographic material Med.1
86 transmittance curve of laserthermographic material Med.2
87 absorption curve of laserthermographic material Med.2
88 reflection curve of laserthermographic material Med.2
101 impact line
102 supply magazine
104 belt
105 tension roller
107 sheet of thermographic imaging element
108 roller
109 roller
110 controller
113 ventilator
116 imaged (and processed) sheets/sheet exit
117 keyboard
118 laser source
119 modulator
120 first objective
121 polygon mirror
122 second objective
123 sheets to be imaged/sheet input
124 sheet feeder
125 imaging and processing unit/recording unit
126 roller
130 flow-chart of method-steps
131 providing step
132 heating & exposing step
133 preheating, exposing & heating steps
134 providing step
135 double heating step
136 preheating step
137 providing step
138 monitoring block
141 indefinite time duration
142 indefinite sequence order
160 measuring equipment
161 light source
162 first light beam
163 first glass plate
164 second glass plate
165 second light beam
166 spectrophotometer
167 computer
168 power supply
169 square wave pulse
X fast scan direction
Y slow scan direction

What is claimed is:

1. A method for recording an image on a thermographic material (m) comprising the steps of providing a thermographic material having a thermal imaging element (Ie), a transparent thermal head (TH) having energisable heating elements (Hi), and a radiation beam (L), activating heating elements of said thermal head and imagewise and scanwise exposing said imaging element by means of said radiation beam, such that the total energy resulting from said thermal head and from said radiation beam has a level corresponding to a gradation of the image to be recorded on said imaging element, wherein said imagewise and scanwise exposing is carried out by passing said radiation beam through transparent parts of said thermal head.

2. The method according to claim 1, wherein said heating step and said exposing step are carried out at least partly simultaneously.

3. The method according to claim 1, wherein said activating of heating elements of a thermal head is carried out imagewise.

4. The method according to claim 1, wherein said imagewise and scanwise exposing by means of a radiation beam is modified in that said imagewise and scanwise exposing is carried out by means of a laserdiodearray.

5. The method according to claim 1, wherein the thermographic material is on one and the same holding or guiding means (15) during both the imagewise exposing step and the heating step.

6. The method according to claim 1, comprising an additional step of controlling said activating heating elements (Hi) of a transparent thermal head by monitoring the gradation while developing said thermal imaging element (Ie) by passing a monitoring beam through said transparent thermal head.

7. A method for recording an image on a thermographic material (m) comprising the steps of providing a thermographic material comprising the thermal imaging element (Ie), a transparent thermal head (TH) having energisable heating elements (Hi), and a radiation beam (L), activating heating elements such that a preheat temperature ($T_0$) in the imaging element is reached which is below the conversion temperature (Tc) of the imaging element, imagewise and scanwise exposing said imaging element by means of said radiation beam having a level of energy corresponding to a gradation of the image to be recorded on said imaging element, heating said thermal imaging element by a heating means (HM) such that a temperature (Tm) in the imaging element is reached which is higher than the conversion temperature (Tc) of the imaging element and which is apt for developing said thermographic material, wherein said imagewise and scanwise exposing is carried out by passing said radiation beam through transparent parts of said thermal head.

8. The method according to claim 7, wherein said heating means comprises a thermal head.

9. A method for recording an image on a thermographic material (m) comprising the steps of providing a thermographic material comprising a thermal imaging element (Ie), at least two thermal heads (TH1, TH2) having energisable heating elements (Hi), and a radiation beam (L), imagewise and scanwise exposing said imaging element by means of said radiation beam having a level of energy corresponding to a gradation of the image to be recorded on said imaging element, activating during a first heating time (t1) heating elements of one of said thermal heads such that a first temperature (Tm1) in the imaging element is reached, activating during a second heating time (t2) heating elements of the other one of said thermal heads such that a second temperature (Tm2) in the imaging element is reached, wherein said imagewise and scanwise exposing is carried out by passing said radiation beam through transparent parts of one of said thermal heads.

10. The method according to claim 9, comprising before said imagewise and scanwise exposing, an additional step of activating heating elements such that a preheat temperature ($T_0$) in the imaging element is reached which is below the conversion temperature (Tc) of the imaging element.

* * * * *